United States Patent [19]

Fujimori

[11] Patent Number: 4,555,184

[45] Date of Patent: Nov. 26, 1985

[54] MODULE FOR COMBINATION TIMEPIECE

[75] Inventor: Motoyuki Fujimori, Shiojiri, Japan

[73] Assignee: Shiojiri Kogyo Kabushiki Kaisha, Suwa, Japan

[21] Appl. No.: 557,036

[22] Filed: Dec. 1, 1983

[30] Foreign Application Priority Data

Dec. 7, 1982 [JP] Japan ..... 57-215287

[51] Int. Cl.[4] ..... G04B 19/04

[52] U.S. Cl. ..... 368/88; 368/82; 368/87

[58] Field of Search ..... 368/76, 79, 80, 82, 368/84, 88, 242, 220

[56] References Cited

U.S. PATENT DOCUMENTS

| | | | |
|---|---|---|---|
| 4,247,930 | 1/1981 | Martin | 368/84 |
| 4,280,209 | 7/1981 | Mooney | 368/76 X |
| 4,355,380 | 10/1982 | Huguenin et al. | 368/82 X |
| 4,435,087 | 3/1984 | Matsumoto et al. | 367/76 |

FOREIGN PATENT DOCUMENTS 2052809A 5/1980 United Kingdom .

*Primary Examiner*—Ulysses Weldon

*Attorney, Agent, or Firm*—Blum, Kaplan, Friedman, Silberman & Beran

[57] ABSTRACT

A module construction includes a power source, frequency source, circuit means, analog display and liquid crystal display. The analog display covers the face of the timepiece and the electronic display overlays the analog display. An analog movement is positioned between a stiff metal reinforcement and a spacer member. Circuit means are provided on a stiff substrate and a thin film substrate laid on said stiffer substrate. The spacer member allows for positioning of discrete electrical and mechanical components between the reinforcement and substrates. A circuit holder member supports the substrates and connects with the reinforcement. A portion of the analog movement extends through an aperture provided in the electrical substrate.

11 Claims, 4 Drawing Figures

MODULE FOR COMBINATION TIMEPIECE

BACKGROUND OF THE INVENTION

This invention relates generally to a hybrid type electronic timepiece of the type having both analog and digital displays, and more particularly to a combination timepiece being small, thin, attractive and allowing for a wide range of electronic displays. Electronic timepieces having a plurality of supplemental functions have been developed rapidly and the combination of a timepiece including a digital display which is convenient to use, and an analog display which makes a nice appearance and is perferred by users for timekeeping, has been requested in the marketplace.

What is needed is a combination timepiece which has all of the advantages of an analog timepiece as well as the advantages of an entirely digital, that is, electronic timepiece.

SUMMARY OF THE INVENTION

Generally speaking, in accordance with the invention, a combination timepiece especially suitable for providing a thin, small and attractive appearance, is provided. A module construction for a combination timepiece includes a power source, frequency source, circuit means, and an analog display including hands and an electronic liquid crystal display. The analog display is conventional and covers the entire face of the timepiece in the conventional manner. The electronic display overlays the analog display with the center of the electronic display being located near the rotational center for the analog hand display. The electronic display is substantially the size of the dial face. Thus, two full sized displays are provided and the analog display is visible through the liquid crystal display elements when the electronic display is not driven. Construction is modular and an analog movement for supporting the hand display is positioned between a stiff reinforcement of metal and a spacer member connected thereto. Circuit means are provided on both a thicker, stiff substrate and a thin film substrate laid on said stiffer substrate. The spacer member separates the substrates from the reinforcement and allows for positioning of the discrete electrical and mechanical components between the stiff reinforcement and the substrates. A circuit holder member supports the substrates and connects by screws with the stiff reinforcement member such that a modular element is produced. An aperture is provided in the electrical circuit substrate through which a portion of the analog movement extends such that a thin timepiece is produced although both analog and digital displays are provided. The dial of the analog display serves as a reflecting surface for the liquid crystal display further enabling a thin construction.

Accordingly, it is an object of this invention to provide an improved module for a combination timepiece wherein the size of one display is not compromised to the advantage of the other type display.

Another object of this invention is to provide an improved module for a combination timepiece which allows for small size and thin construction despite having both an analog and also a digital display.

A further object of this invention is to provide an improved module for a combination timepiece which allows for assembly and disassembly without stressing the connections between substrates and discrete components.

Still other objects and advantages of the invention will in part be obvious and will in part be apparent from the specification.

The invention accordingly comprises the features of construction, combination of elements, and arrangement of parts which will be exemplified in the construction hereinafter set forth, and the scope of the invention will be indicated in the claims.

BRIEF DESCRIPTION OF THE DRAWINGS

For a fuller understanding of the invention, reference is had to the following description taken in connection with the accompanying drawings in which.

DESCRIPTION OF THE PREFERRED EMBODIMENTS

This invention relates to a circuit and structural configuration for a combination timepiece, that is, a hybrid timepiece, having both analog hand display means and also an electronic display means. More particularly, the modular arrangement of circuits and structure is described with reference to FIGS. 1 through 4.

Figure 1:
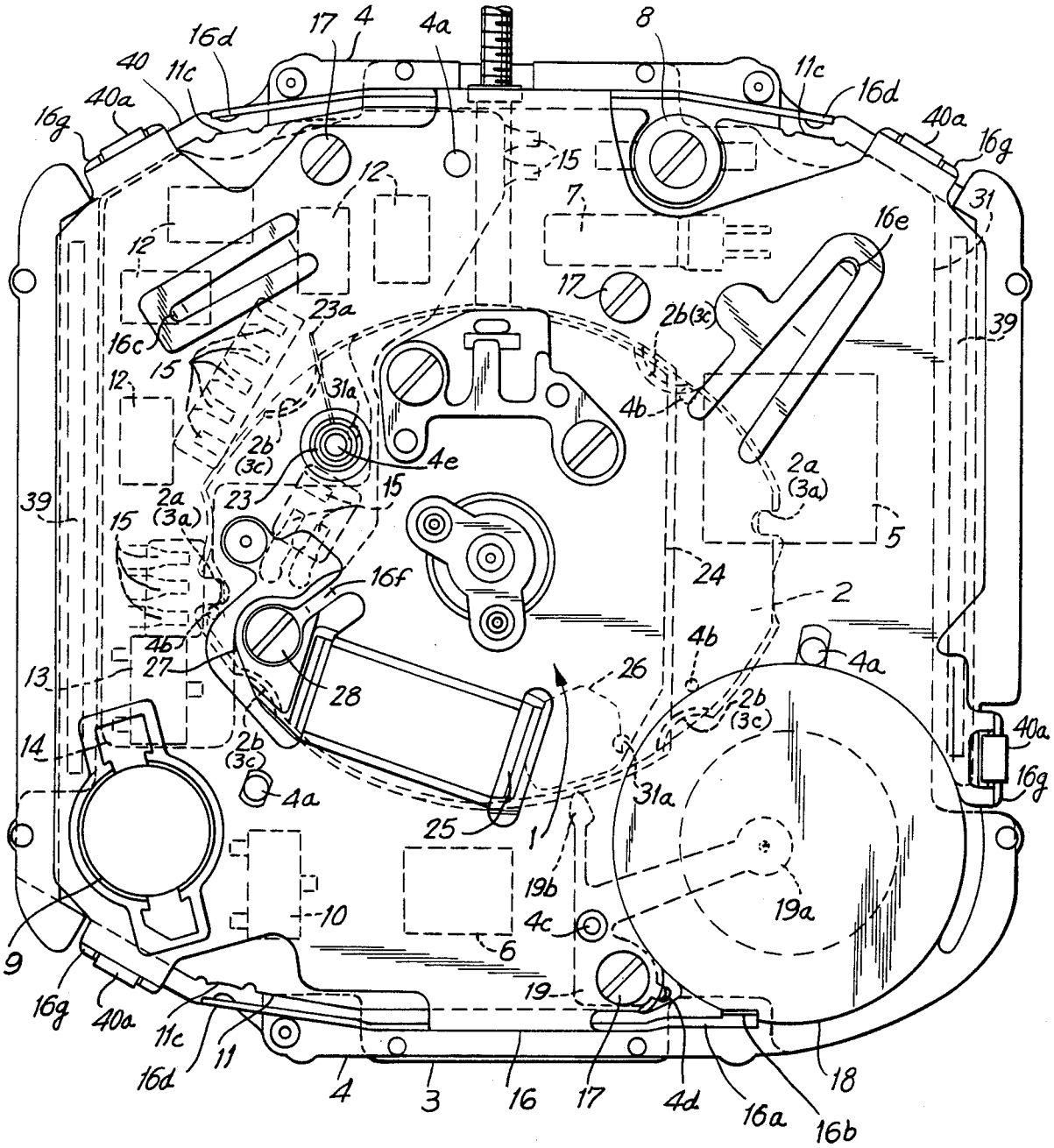
FIG. 1 is an assembly plan view of a module for a combination timepiece having a modular construction in accordance with the invention.

FIG. 1 includes an analog movement 1 which is held for positioning in the depth direction of the timepiece in engagement with a reinforcement 3 made of metal and having a central aperture and a portion 3*a* protruding therein. The analog movement 1 includes a plate 2 having a recessed portion 2*a* for engagement with the protruding portion 3*a* of the reinforcement 3. Thus the analog movement 1 is also held in the length direction of the timepiece.

Notched portions 2*b*, of which there are four such portions, provided on the periphery of the plate 2 in the width direction of the timepiece are supported by 4 semi-circular projection portions 3*c* of the reinforcement 3. The projecting portions 3*c* also extend into the central aperture of the reinforcement 3.

A spacer member 4, made of a synthetic resin material, is supported by 3 tubes 3*b* fixed to the reinforcement 3 for engagement with bridge screws 17.

A thin film circuit substrate 14 on which condensers 12, a diode 13, and the like, that is, discrete circuit components, are positioned, is supported in such a manner that a plurality of electrode finger portions 15, overhanging from the external outline of the circuit substrate 14, are fixed with solder to a stiff circuit substrate 11.

Further, the plate 2 is pressed, by a plurality of protruding portions 4*b* extending from the spacer member 4, by fixing a metal circuit holder member 16 by a projecting portion 4*a*, of which there are three in number provided in the spacer member 4, and to the tubes 3*b* for a bridge screw, with a screw 17 of which there are also three. Therefore, the analog movement 1 is fixed in place.

A battery 18 as a power source is positioned near the module corner, near the position of 11 o'clock of the analog movement, so that the largest possible planar space (FIGS. 1, 4) is obtained and the battery 18 does not touch the analog movement 1 as seen in the sectional views. With regard to conduction between the cathode of the battery 18 and a circuit, a flexible resilient portion 19*a* of the battery negative terminal 19 is in pressure contact with the cathode of the battery 18, and flexible resilient portion 19*b* is in pressure contact with an electrode terminal portion 11*a* provided on the circuit substrate 11. The battery negative terminal 19 is positioned by an end extending into a hole 4*d* of the spacer member 4 (FIG. 3) and by an aperture in the terminal 19 receiving the projection 4*c* of the spacer member 4.

Figure 2:
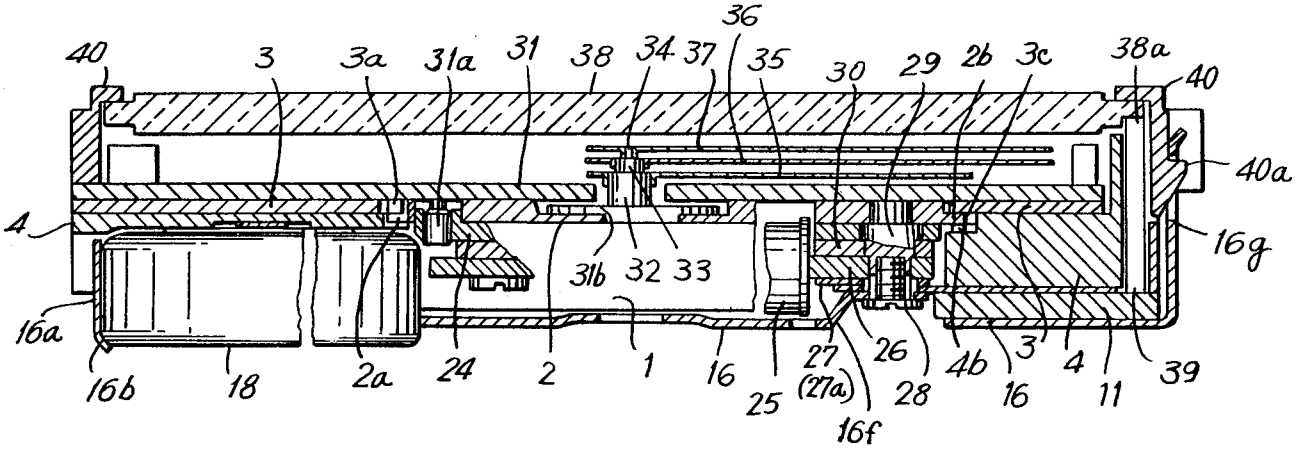
FIGS. 2 and 3 are sectional views of the module of FIG. 1.
Figure 3:
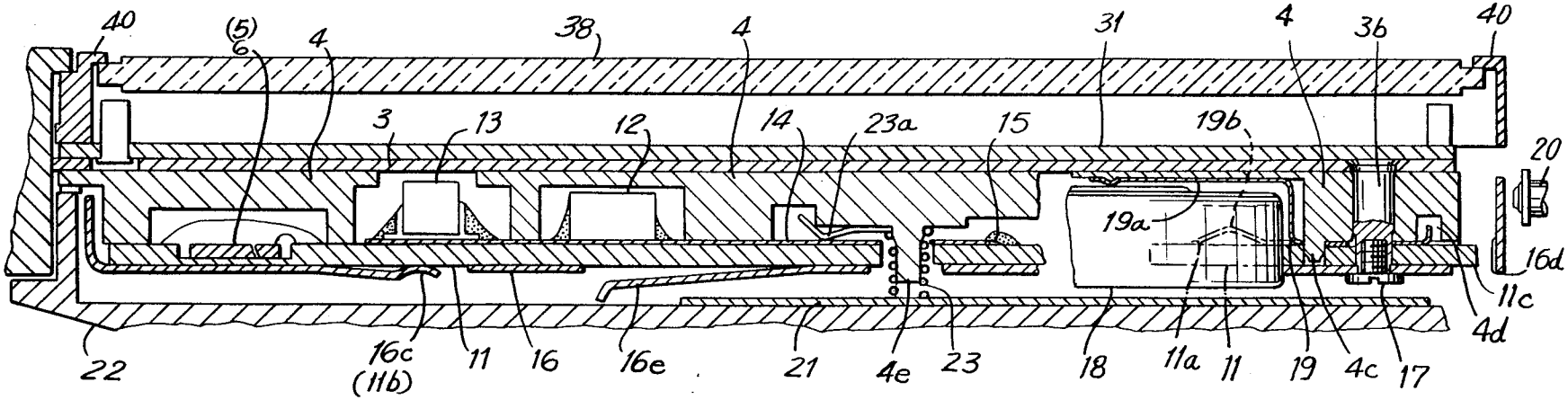
Figure 4:
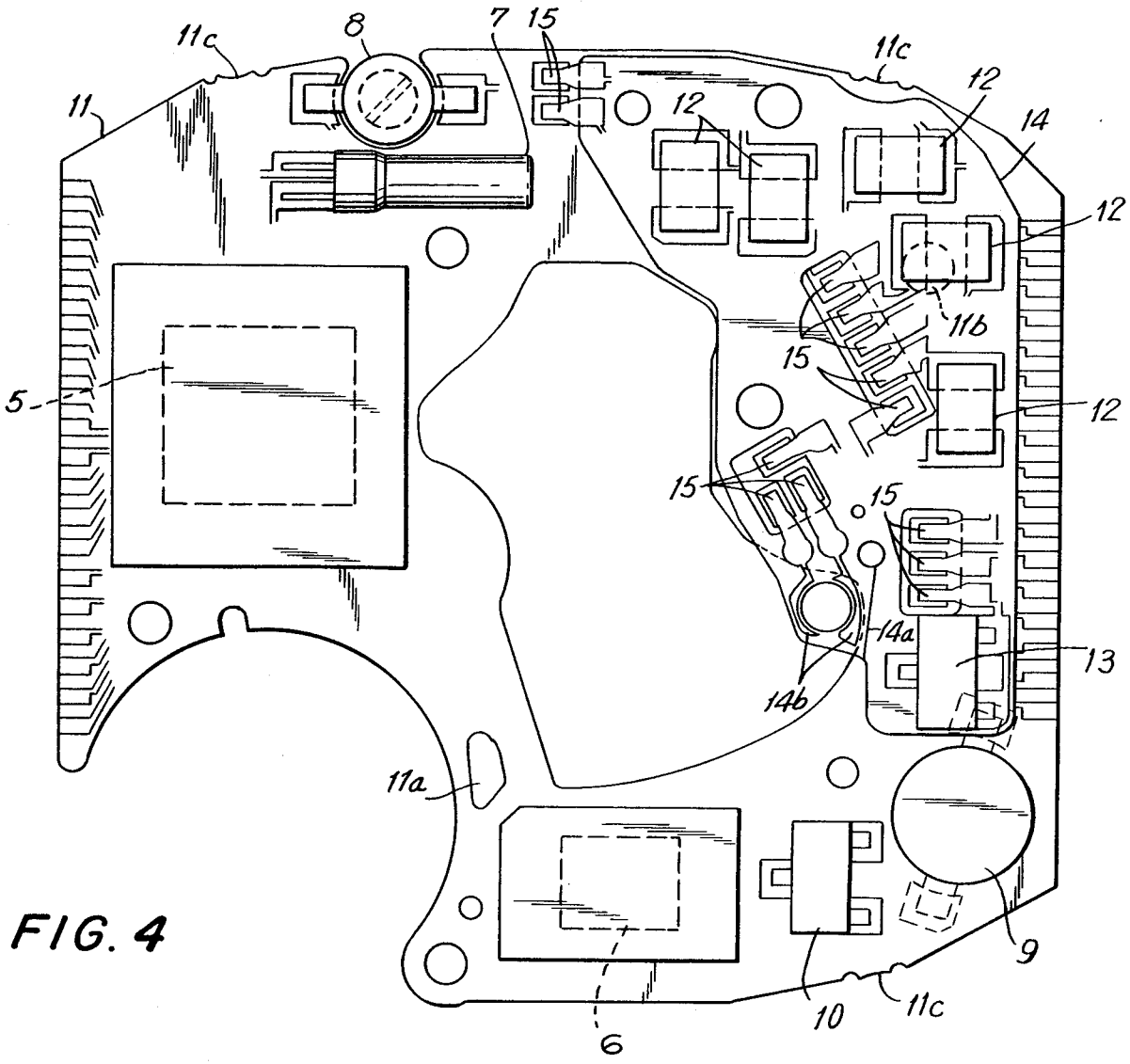
FIG. 4 is an assembly plan view of the circuit means of the module of FIG. 1.

On the other hand, with regard to connecting the anode of the battery 18 with the circuit, the side of the battery 18 is fixed to the circuit holder member 16 by elastically pressing a bent positive terminal 16*a* (FIG. 2). Further, the anode corner portion of the battery 18 is supported by a bent portion 16*b* provided at the end of the positive terminal 16*a* so as to prevent the battery from changing its position. Further, a flexible resilient portion 16*c*, provided on the circuit holder member 16, is in pressure contact with an electrode terminal portion 11*b* provided on the circuit substrate 11. The circuit holder member 16 also has three resilient portions 16*d, e, f*. The resilient portion 16*d* engages with a button 20 of an external operational member (FIG. 3), and an electrode-portion 11(c) formed at the side surface of the circuit substrate 11 is contacted by pressing the button 20 so that an input signal is provided thereby.

The elastic portion 16(e) makes pressure contact with a case back 22 having a piezoelectric element 21 fixed thereto so as to be electrically grounded. A lead terminal 23 for a buzzer for electrically connecting to the piezoelectric element 21 by pressing thereon, is supported by a projecting portion 4(e) of the spacer member 4. An end portion 23*a* of the lead terminal 23 is supported between the thin film circuit substrate 14, having an electrode portion for conducting at that location, and the spacer member 4. The lead end portion 23*a* makes contact and conducts to provide a buzzer driving signal.

A coil end is connected to an electrode pattern 27*a* of a coil lead substrate 27 fixed to a magnetic core 26 of a coil block 25. The thin film circuit substrate 14, provided with the electrode pattern for outputting the driving signals, is positioned so as to overlap with the electrode pattern of the lead substrate 27. A stator 30 and a magnetic core 26 are fixed for attachment to a tube 29 for a bridge screw, fixed to the plate 2 by a screw 28 through an elastic portion 16*f* of the circuit holder member 16. The thickness of this screwed-together assembly varies substantially, because it is affected by variations or scatter in the thicknesses of the above mentioned components.

Thus, a slit 14*a* (FIG. 4) is provided in the vicinity of the driving signal conductive connecting portion 14*b* of the circuit substrate 14, so that the degrees of freedom of movement in the vertical and longitudinal directions are increased, and the fixed portion of an electrode finger portion 15 is not adversely affected by a peel stress. Further, the spring width of the elastic portion 16*f* is made thin so as not to have a bad effect on the circuit. When the circuit means is disassembled, the screw 28 is loosened without the circuit substrate 14 being peeled. The spacer member 4 is positioned on the circuit substrate 11 surrounding the analog movement 1 and some gaps are provided between the spacer member 4 and the above mentioned circuit elements arranged within the space between the reinforcement 3 and the circuit holder member 16 by providing recessed portions and apertures. Further, an insulating coating is provided on the front and back sides of the circuit substrate 11 in order to attain high water vapor resistance and to insulate the circuit holder plate 16.

A dial 31 is fixed to the analog movement 1 by pressure fitting a dial foot 31*a* into a bridge washer 24. Hand display means is constructed by fixing an hour hand 35, minute hand 36 and second hand 37 to an hour wheel, center wheel and pinion, and a fourth wheel and pinion (not shown) respectively, which are positioned through an opening 31*b* in the center of the dial 31 (FIG. 2).

A liquid crystal panel 38 providing an electronic display means, is positioned to cover the entire hand display portion. That is, the face dimensions of the electronic liquid crystal display are not generally constrained by the face dimensions of the hand display. An elastic conductive rubber element 39 (FIGS. 1, 2) is positioned between the circuit substrate 11 and an input signal receiving portion 38*a* provided at the external end, that is in the 12 through 6 o'clock region of the liquid crystal panel 38 when associated with an analog timepiece. The hooked portion 16*g* of the circuit holder member 16, having an elastic portion, engages with a projecting portion 40*a* of a panel frame 40 so as to mechanically support the liquid crystal panel 38, which is electrically connected by the elastic force of the elastic conductive rubber member 39.

Positioning the liquid crystal panel over the hand display portion, as described above, makes the timepiece thicker as a general concept. However, in accordance with this invention, the increase in thickness of the module is minimized by placing a portion of the analog movement 1 in the aperture provided in the circuit means. Further, a timepiece in accordance with this invention is made not only thinner but also smaller in size by positioning the battery, circuit elements, etc., in an equal distribution around the analog movement 1, and by overlapping the film circuit substrate 14, on which the discrete components such as the condensers 12, and the like, are arranged on one plane, with the circuit substrate 11. Furthermore, the stiff circuit substrate 11 reduces the strains which occur during installation or other disturbances, in prior art designs when stiffness of the substrate is diminished by being made thin. Here, this stiffness efficiently prevents the condensers 12 from cracking or chipping. Additionally, the coil 25 and circuit means are electrically connected only by pressing against the circuit substrate 14 so that the number of components is decreased, and they are of small size. The effect of a scatter in dimensions of the components is reduced by providing the slit portion 14*a* in the thin circuit substrate 14 so that conduction is dependable and durable. Additionally, the wiring pattern is made simplified within the small space of a circuit substrate 11, provided with the central aperture, so that processing performance is improved by eliminating pattern chipping or a leak between patterns. Further, the electrode finger portions 15 overhung from the external contours of the thin film circuit substrate 14, are structurally and electrically connected to the circuit substrate 11 by soldering, or the like, without using other components.

In a combination display timepiece in accordance with the invention, the liquid crystal panel 38 is positioned above the upper surfaces of the analog hands 35, 36, 37 so that a larger display area is provided as compared with conventional combination, that is, hybrid analog and digital, timepieces. Further, the combination timepiece in accordance with the invention is made thin, without damaging the appearance found in a conventional analog timepiece, by using the dial 31 in place of a reflector for the liquid crystal display. Light transmission of polarizing plates attached to the upper and lower surfaces of the liquid crystal panel 38 is more than 45% so as to satisfy the display quality and appearance of a digital timepiece and yet not damage the fine appearance of an analog timepiece.

In order to brighten the appearance of the display surface, the dial surface is made rough so that incident light rays from the liquid crystal panel produce irregular reflections, and a dial whose color tone is very light is used. Thus, a combination timepiece having an appearance which is by no means inferior to that of a conventional analog timepiece, is provided. To make it easy to observe the hands, the surfaces of the hands are made dark in color so as to contrast with the appearance of the dial.

Otherwise, the objective of good appearance and readability can be attained by using a specular surface on the hands so that light is reflected. The appearance of the electronic display and the appearance of the analog display can be made to match each other by the above techniques.

As stated above, in accordance with the invention, several kinds of digital displays other then timekeeping, for example, a display integrating in steps, an alarm schedule, and the like, are achieved according to the user's demands. At the same time a superior analog display is provided in a timepiece which comprises a liquid crystal panel having a wide display area over the hand display portion. The timepiece can remain thinner, smaller in size and less expensive than a conventional hybrid timepiece by using a simple construction. As a result, a more attractive timepiece is obtained.

It should be understood that many details of mechanical and electrical construction which are included in a timepiece in accordance with the invention but are conventional have not been described in detail, if at all, herein. For examples, the motor/rotor/gear train for driving the hands, the integrated circuitry and the associated discrete frequency resonator, basic to both analog and digital timekeeping are among those portions which have not been described.

It will thus be seen that the objects set forth above, and those made apparent from the preceding description, are efficiently attained and, since certain changes may be made in the above constructions without departing from the spirit and scope of the invention, it is intended that all matter contained in the above description or shown in the accompanying drawings shall be interpreted as illustrative and not in a limiting sense.

It is also to be understood that the following claims are intended to cover all of the generic and specific features of the invention herein described, and all statements of the scope of the invention which, as a matter of language, might be said to fall therebetween.

What is claimed is:

1. A combination time piece of modular construction comprising:

a power source;

a frequency source coupled to the power source;

circuit means for performing timekeeping functions, having an aperture therein, coupled to the power source and frequency source;

an analog dial;

a spacer member disposed between the dial and the circuit means, said spacer member having a second aperture aligned with the aperture of said circuit means;

stiff reinforcement member disposed between the dial and spacer means an analog movement coupled to the circuit means, a portion of said analog movement being positioned in said apertures in said circuit means and spacer member to reduce a dimension of the timepiece;

analog hand display means coupled to the analog movement on top of the circuit means, said analog hand display means having a rotational center; and electronic liquid crystal display means coupled to the circuit means and overlying the analog hand display means, said electronic liquid display means covering the rotational center of the analog hand display means.

2. A module for a combination timepiece as claimed in claim 1, wherein said hand display means are on the opposite side of said reinforcement member from said spacer member, said analog dial face being adjacent to said opposite side of said reinforcement member.

3. A module for a combination timepiece as claimed in claim 1, and further comprising a circuit holder member on the opposite side of said circuit means from said spacer member, said circuit holder member overlapping said spacer member, and means for releasably connecting said circuit holder member with said reinforcement member, said circuit means, spacer member and analog movement being therebetween.

4. A module for a combination timepiece as claimed in claim 3, wherein said circuit means includes a thin film circuit substrate overlapping a stiff circuit substrate, said circuit elements being disposed on said circuit substrates to generally surround said analog movement.

5. A module for a combination timepiece as claimed in claim 1, wherein said analog movement includes a coil block having an input portion, said circuit means including at least one substrate overlapping said driving signal input portion and making conductive contact therewith, and a slit in said at least one substrate located in proximity with said input conductive portion, said slit allowing additional degrees of freedom of motion for said at least one substrate in said region of conductive contact.

6. A module for a combination timepiece as claimed in claim 4, wherein said thin film circuit substrate includes a pattern of electrode portions projecting from the periphery of said thin film substrate, said thin film circuit substrate and said stiff circuit substrate being overlapped with said electrode pattern on said thin film substrate contacting conducting surfaces on said stiff substrate, circuit elements on said substrates being connected together electrically through said electrode pattern portion.

7. A module for a combination timepiece as claimed in claim 5, wherein said circuit holder member is electrically conductive and a portion of said circuit holder member presses against a driving signal connecting portion on said thin film circuit substrate to complete a circuit.

8. A module for a combination timepiece as claimed in claim 4, wherein said substrates, reinforcement member and spacer member are generally planar overlapped layers, said spacer member being contoured to cradle therein said analog movement and at least a portion of said electrical elements connected to said substrates, and at least a portion of said power source.

9. A module for a combination timepiece as claimed in claim 8, wherein said reinforcement member includes a central aperture, said analog movement being supported in said aperture.

10. A module for a combination timepiece as claimed in claim 2, wherein said dial face serves as a reflector for said electronic display.

11. A module for a combination timepiece as claimed in claim 1, wherein said reinforcement member includes a central aperture, said analog movement being supported in said aperture.

* * * * *